US005702036A

United States Patent [19]

Ferrara, Jr.

[11] Patent Number: 5,702,036

[45] Date of Patent: Dec. 30, 1997

[54] AEROSOL TOTAL RELEASE ACTUATOR HAVING A DELAY IN PRODUCT EMISSION

[75] Inventor: Daniel A. Ferrara, Jr., Bantam, Conn.

[73] Assignee: Precision Valve Corporation, Yonkers, N.Y.

[21] Appl. No.: 524,892

[22] Filed: Sep. 7, 1995

[51] Int. Cl.[6] ..... B65D 83/20

[52] U.S. Cl. ..... 222/402.13; 222/477

[58] Field of Search ..... 222/402.13, 402.14, 222/402.15, 476, 477, 649, 212, 213, 207

[56] References Cited

U.S. PATENT DOCUMENTS

| | | | |
|---|---|---|---|
| 2,899,113 | 8/1959 | Forster et al. | 222/477 |
| 3,341,082 | 9/1967 | Meshberg | 222/477 |
| 3,519,171 | 7/1970 | Kinnavy | 222/477 |
| 3,968,905 | 7/1976 | Pelton | 222/477 |

*Primary Examiner*—Philippe Derakshani
*Attorney, Agent, or Firm*—Kilgannon & Steidl

[57] ABSTRACT

This invention is a total release actuator having a structure that provides a time delay between the activation of an aerosol valve in an associated aerosol container and the discharge of product through the actuator. The structure effecting the time delay is an inflatable and movable component which slowly expands and moves upwardly when product is slowly introduced from the container to a closed chamber defined in part by the inflatable and movable component; the closed chamber being initially out of registry with a discharge conduit and orifice but which, after the chamber is slowly filled with product, moves into register with the said discharge conduit and orifice and product is discharged.

7 Claims, 2 Drawing Sheets

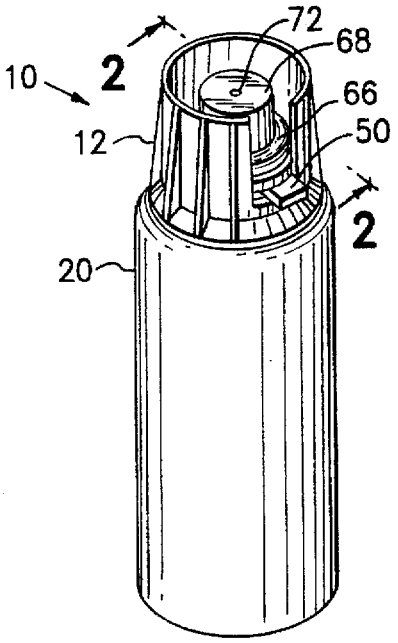
FIG. 1
FIG. 2
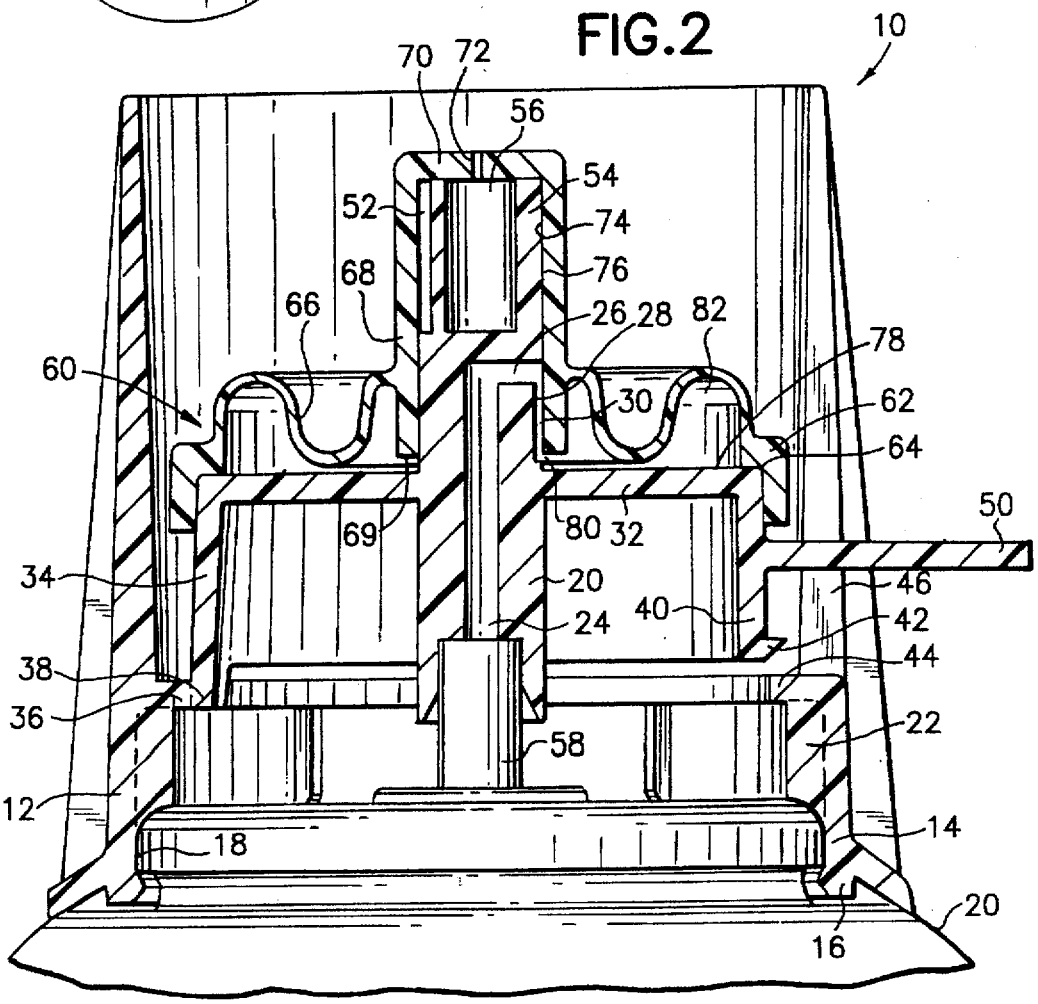

AEROSOL TOTAL RELEASE ACTUATOR HAVING A DELAY IN PRODUCT EMISSION

BACKGROUND OF THE INVENTION

Various products are dispensed by pressurized aerosol dispensers. Some products such as fumigants, air fresheners, and fogging insecticides benefit from an actuator which opens and holds open the dispenser valve permitting the user to leave the aerosol dispenser as it continues to dispense the contents to the air. Examples of aerosol dispenser actuators having the capability of continuous, unattended dispensing are found in Scoggin, Jr. et al. U.S. Pat. No. 3,081,918, Alplanalp U.S. Pat. No. 3,260,416, Steinkamp U.S. Pat. No. 3,137,414, Beres et al. U.S. Pat. No. 3,305,144, Doblin U.S. Pat. No. 3,314,577, Scheck U.S. Pat. No. 3,325,064 and Hayes U.S. Pat. No. 4,381,065.

These actuators are commonly referred to as "total release" actuators by the aerosol industry.

The above-noted total release actuators provide an instantaneous delivery of the product from the aerosol container that continues until the product is completely evacuated from the container or the mechanism for holding the aerosol valve controlling flow from the container is released from the valve hold-down position. The instantaneous delivery of product causes product to be sprayed and disseminated throughout the area. In the case of a closed area, such as a room in a residence, the party activating the total release actuator is subjected to the product emission spray until such time that the party is able to vacate the area in which the aerosol container is placed. The odor and spray of the product emission is often unpleasant and, for some, perhaps a cause of a dermatological or respiratory discomfort. Thus, it is desirable that the aerosol industry be provided with a device that permits actuation of the aerosol valve having a time delay after valve actuation but prior to discharge of product so that the party actuating the aerosol valve may exit the area to be sprayed before product emission is initiated.

SUMMARY OF THE INVENTION

The present invention is a total release actuator having a structure that provides a time delay between the activation or opening of the aerosol valve and the commencement of the discharge of product from the container to the ambient environment. In its broadest scope, the aerosol actuator of this invention comprises:

(a) means for mounting the actuator onto an aerosol container, (b) means, associated with the means for mounting, including an actuating member, for actuating and holding in the open position an aerosol valve of an associated container, said means having a conduit portion extending therethrough which communicates at one end with the downstream side of an associated aerosol valve, and said actuating means further having a portion extending laterally from the conduit portion, (c) an inflatable and movable component disposed in an interference and slidable relationship with a portion of the outside surface of the conduit portion said inflatable component, the laterally extending portion of the actuating means and the outside surface of the conduit portion defining a closed chamber, (d) the conduit portion of the actuating means communicating with the closed chamber at the end of the conduit distal to the end of the conduit communicating with the downstream side of the aerosol valve and the actuating means further having a groove and discharge orifice in the upper conduit portion out of registry with the closed chamber when actuating member is in the non-actuation mode, and (e) a flow-control orifice communicating the conduit portion and the closed chamber so as to provide a time delay in filling the closed chamber with product.

More particularly, the inflatable closed chamber of this invention comprises a bellows-like structure that slowly fills with product upon actuation of the aerosol valve and ultimately rapidly inflates after the chamber starts to inflate and move the inflatable component into registry with the groove in the outer wall of the conduit and concomitantly communicate the interior of the closed chamber and the discharge orifice.

The actuator of this invention provides a "total release" structure that allows the person activating the aerosol valve to leave the area wherein the container is placed before the emission of the contents of the container. It has been found that a time delay of ten–fifteen seconds is more than an adequate period for a person to leave the area wherein the aerosol container is being discharged.

BRIEF DESCRIPTION OF THE DRAWINGS

FIG. 1 is a perspective view of the actuator of this invention mounted on an aerosol container.

FIG. 2 is a sectional drawing of the actuator of this invention showing the closed chamber in a deflated configuration.

DETAILED DESCRIPTION OF THE PREFERRED EMBODIMENT

Figure 3:
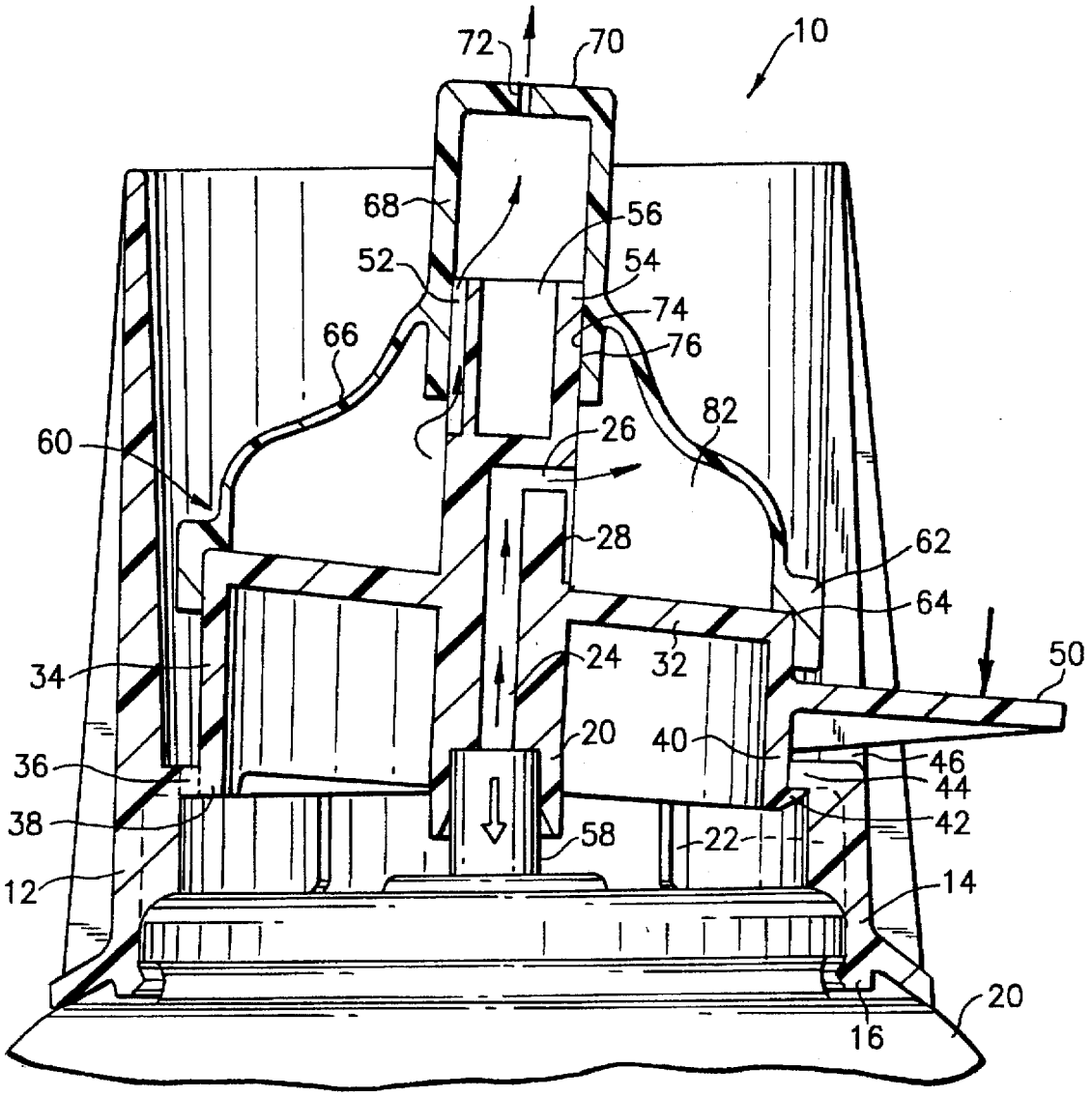
FIG. 3 is a sectional drawing of the actuator of this invention showing the closed chamber in an inflated configuration with the interior of the closed chamber in registry with the groove in the outside wall of the product conduit and the discharge orifice.

FIG. 1 illustrates the actuator, generally designated as 10, having an upstanding outer wall portion 12, a base portion 14 terminating in an inwardly extending annular lip 16, adapted to snap over and under the perimeter of the mounting cup 18 (shown in partial section) to thereby affix the actuator to the aerosol container 20 (partial section). Ribs 22 are disposed on the inside wall of the base portion 14, said ribs 22 functioning to reinforce the actuator but, more significantly, to act as a stop when the actuator is placed atop the mounting cup, i.e., the ribs 22 and the annular lip 16 are dimensionally related to provide a snap fit of the actuator onto the mounting cup of an aerosol container. Disposed within the outer wall portion 12 of the actuator 10 is a valve stem receiving socket 20 having a central conduit 24 extending through a portion of its length, said conduit having a laterally extending portion 26 terminating at the outside wall 28 of the socket 20. In the outside wall 28 of the socket 20, there is a groove 30 which communicates with the lateral portion 26 of the conduit 24. Extending radially outward from the socket 20 is a platform 325 the platform 32 covering most of the space interior of the upstanding outer wall portion 12. The platform 32 has a portion 34 which extends substantially in the direction of the vertical axis of the socket 20 and at one side is connected to the lower portion of the upstanding outer wall 12 by a hinge 36. The portion 34 has a length 38 for only a short distance on each side of the hinge 36 and then assumes the length 40. Laterally across from the hinge 36 is a locking tab 42 extending radially outward from the portion 34. A slot (not shown) extends from the base of the locking tab 42 upwardly in the wall 40 on each side of the locking tab 42 to allow the locking tab to flex inwardly when the tab 42 passes over the locking shoulder 44. Extending radially outward from the portion 34 and through a finger recess 46 in the upstanding outer wall portion 12 is an actuator lever 50. There is a groove 52 in the outer wall 54 of the socket 52 and a recess 56 centrally disposed in the portion of the socket 20 distal to the valve stem 58 of the aerosol valve (not shown).

A flexible and expandable bellows member, generally designated as 60, has a base 62 configured to attach to the platform 32 at the joinder 64 of its laterally extending portion 32 and the downwardly extending portion 34. The base 62 is permanently affixed to the platform 32 through suitable means known to those skilled in the art, for example, by a sonic weld. Extending radially inward of the base 62 is a bellows portion 66 which terminates at its end distal to the base 62 in an annular sleeve-like member 68. The bellows portion 66 is joined to the member 68 at a point above the lower end 69 of the member 68. The member 68 has a top portion 70 with a discharge orifice 72 the inner surface 74 of the sleeve-like member 68 having a slidable interference fit with the outer surface 76 of the socket 20 about the platform 32. Disposed in the upper surface 78 is an opening 80, which communicates on one side with the groove 30 and on the other side with a chamber 82 defined by the lower portion of the sleeve-like member 68, the bellows portion 66 and the upper surface 78 of the platform 32. It has been found that an opening 80 having a width of 0.010" and a depth of 0.015 will provide a sufficient opening to fill the bellows and move the bellows portion 66 and the sleeve-like member 68 along the outer surface of the socket 20 and its registry with the groove 52, thus providing a delay of 10–15 seconds from the initial actuation of the aerosol valve to the initiation of product discharge; such a delay providing sufficient time for the party actuating the aerosol valve to leave the area in which the aerosol product is intended to be sprayed.

The actuator may be fabricated from any of a number of polymers materials. It has been found that polypropylene is a suitable material. Moreover, a bellows portion of the inflatable and movable component having a thickness of 0.015" has been found satisfactory to function as the inflatable component.

The actuator 10 may have a tamper-evident mechanism of a type known to those skilled in the art to signal to the user that the actuator may have been previously been actuated. The tear-away type of temper-evident structure is satisfactory, i.e., a type where to access the actuator lever it is necessary to remove the temper-evident structure.

In FIG. 2, the components of the actuator are the same as shown and described for FIG. 1. FIG. 2 shows the actuator with the actuating lever in the downward and locked position, thereby holding the aerosol valve in a fully open position. Concomitantly, the bellows portion 66 has expanded and moved the sleeve-like member 68 to a position wherein the chamber 82 is in registry with the groove 52 and the product of the aerosol container is free to pass from the chamber 82 through the groove 52 and then through the discharge orifice 72.

While it is apparent that the invention herein disclosed is well calculated to fulfill the objects previously stated, it will be appreciated that numerous modifications and embodiments may be devised by those skilled in the art, and it is intended that the appended claims cover all such modifications and embodiments as fall within the true spirit and scope of the present invention.

I claim:

1. An actuator for the total release of the product within a valved aerosol container, said actuator having a mechanism to delay the discharge of the product through the actuator from the time of the initial opening of the aerosol valve comprising:

(a) means for mounting the actuator to a valved aerosol container, including an upstanding outer walls;

(b) a socket portion having a recess at one end to receive in sealed relation a valve stem of an aerosol valve, the socket portion having an upstanding portion with a conduit therein extending upwardly from the valve stem receiving recess and terminating as an opening through the upstanding portion; said upstanding portion further having a groove in its outer surface commencing at the top of the upstanding portion;

(c) the socket portion having a platform extending radially outward from the upstanding portion, the platform having a downwardly extending wall and forming a hinge connection with the means for mounting the actuator to a valved aerosol container, the downwardly extending wall further having a means for actuating and holding in open position the aerosol valve of an associated container;

(d) an inflatable and movable component disposed in an interference and sliding relationship with the outside surface of the socket portion and defining, together with said socket portion, a closed chamber;

(e) the groove and conduit opening in the upstanding wall of the socket being disposed so as to be out of registry with the interior of the closed chamber when the valve of an associated aerosol container is in a closed or non-actuated position.

2. The actuator of claim 1, and further wherein the lateral platform portion has a downwardly extending portion that is connected to the mounting means by a hinge portion, a second downwardly extending portion of shorter length terminating in a flexible locking tab and further said mounting means having an inwardly directed shoulder that receives the locking tab when the actuating means is depressed to hold open an associated aerosol valve.

3. The actuator of claim 2, and further wherein the base of the mounting means has spaced radially inward directed tabs on the inner surface of the base and an annular inwardly directed lug, which tabs and lug provide a snap-lock retention of the actuator onto the mounting cup of an associated aerosol valve container.

4. The actuator of claim 1, and further wherein the inflatable and movable component has a perimeter portion which is permanently affixed to the perimeter of the lateral portion of the actuating means, and a bellows portion extending radially inward from the perimeter portion and terminating in a sleeve-like portion which is in interference and slidable relationship with the outside surface of the socket portion of the actuating means, the bellows portion, the lateral platform portion and the sleeve-like portion of the inflatable and moving component defining a closed chamber which communicates with the flow-control opening.

5. The actuator of claim 4, and further wherein the sleeve-like portion of the inflatable and movable component abuts the top surface of the lateral platform portion of the actuating means and the flow-control opening is disposed at the interface between sleeve-like portion and the top surface of the lateral platform portion.

6. The actuator of claim 1, and further wherein the discharge orifice in the sleeve-like portion of the inflatable and movable component is disposed in a top surface of the sleeve-like portion so as to provide a vertical discharge of product when the valve of the aerosol container is actuated and the aerosol container is in an upright attitude on a surface.

7. The actuator of claim 2, and further wherein the socket portion of the actuating means extends beyond the lateral platform portion of the actuating means and wherein the conduit in the actuating means has a lateral portion which communicates with the flow-control opening.

* * * * *